US006665882B1

(12) United States Patent
Pedrick

(10) Patent No.: US 6,665,882 B1
(45) Date of Patent: Dec. 23, 2003

(54) SURFING SHORTS WITH WETSUIT UNDERGARMENT

(76) Inventor: Webster Pedrick, 234 Kupaa St., Paia, HI (US) 96779

( * ) Notice: Subject to any disclaimer, the term of this patent is extended or adjusted under 35 U.S.C. 154(b) by 0 days.

(21) Appl. No.: 10/389,216

(22) Filed: Mar. 14, 2003

(51) Int. Cl.[7] ..... A41D 1/06
(52) U.S. Cl. ..... 2/228
(58) Field of Search ..... 2/228, 67, 82, 2/79, 2.15, 220, 235–237, 223, 238, 400, 403, 69, 401, 406, 2.16

(56) References Cited

U.S. PATENT DOCUMENTS 2,034,312 A * 3/1936 Rubin ..... 2/228
2,446,326 A * 8/1948 Guithues ..... 2/238
4,282,608 A * 8/1981 Amberg ..... 2/227
5,068,920 A * 12/1991 Bray ..... 2/456
5,598,586 A * 2/1997 Munjone ..... 2/237
6,041,437 A * 3/2000 Barker et al. ..... 2/82

* cited by examiner

*Primary Examiner*—Tejash Patel
(74) *Attorney, Agent, or Firm*—Donald W. Meeker

(57) ABSTRACT

The present invention relates to a wet suit undergarment and surfing shorts combination. The combination comprises a wet suit underpants garment formed of insulating material, preferably Neoprene, capable of covering and conforming to the body of a wearer from their waist to their thighs. The wet suit underpants garment traps a thin layer of water between itself and the wearer's body, thereby maintaining the temperature of the thin layer of water similar to the temperature of the body of the wearer. The combination further comprises pair of outerwear short pants capable of covering and concealing from view the wet suit underpants garment. An interconnecting means is located around at least a portion of the waist of both garments and is capable of securing the wet suit underpants garment to the pair of outerwear short pants so that they are capable of remaining interconnected during water sports activity.

7 Claims, 3 Drawing Sheets

SURFING SHORTS WITH WETSUIT UNDERGARMENT

BACKGROUND OF THE INVENTION

1. Field of the Invention

The present invention relates to water sports attire and in particular to a surfing wet suit garment designed to be concealed under and removably attached to a pair of shorts.

2. Description of the Prior Art

Much of the surfer's time is spent paddling the board in order to attain proper positioning for catching and riding waves. When the water and/or air is relatively warm, surfers generally prefer to wear only a bathing suit and/or a pair of board shorts.

Wet suits are required when the weather and/or water temperature is cooler. Wet suits are suits made of thermally insulating rubberized material, generally designed to fit close to the body, and adapted so that a thin layer of water exists between the suit and the wearer's body. The suit once wet, does not exchange much water, thus the thin layer of water adjacent the wearer's body provides an insulating function.

Prior art U.S. patent application Ser. No. 20020023283, issued Feb. 28, 2002 to Kania, discloses an article of apparel designed to be worn by divers and swimmers which is formed by placing a prefabricated male mold inside a prefabricated female mode. Then a polymeric material is injected into a gap formed between the male mold placed inside the female mold. Also included is a built-in air bladder system to change the buoyancy of the diver and swimmer.

Prior art U.S. patent application 20020026664, issued Mar. 7, 2002 to Grounds, provides a garment for use in water sports that is designed to protect one or more vulnerable regions of a person's body considered susceptible to injury associated with repetitive contact with a hard surfboard surface. The invention comprises a body garment that has an inside surface and an outer surface; and one or more than one cushioning pad connected to the body garment. The cushioning pad or pads are disposed adjacent the inside surface, or the outer surface, or the inside surface and the outer surface, and positioned in juxtaposition to the one or more than one vulnerable region of the body, and one or more than one insert pad for insertion into one or more than one pocket. The vulnerable regions may be optionally selected from the group consisting of the body area in proximity to the ribs, upper hips, elbows, inner elbows, knees, ankles, front of ankles adjacent the feet, and lower back.

Prior art U.S. Pat. No. 6,434,749, issued Aug. 20, 2002 Grounds, shows a garment for use in water sports that is designed to protect one or more than one vulnerable region of a person's body considered susceptible to injury associated with repetitive contact with a hard surfboard surface. The invention comprises a body garment that has an inside surface and an outer surface and one or more than one cushioning pad connected to the body garment. The cushioning pad or pads are disposed adjacent the inside surface, or the outer surface, or the inside surface and the outer surface, and positioned in juxtaposition to the one or more than one vulnerable region of the body, and one or more than one insert pad for insertion into one or more than one pocket. The vulnerable regions may be optionally selected from the group consisting of the body area in proximity to the ribs, upper hips, elbows, inner elbows, knees, ankles, front of ankles adjacent the feet, and lower back.

Prior art U.S. Pat. No. 6,041,437, issued Mar. 28, 2000 to Barker, claims a waterproof thermal insert for outdoor sport pants. The insert is sewn into the rear of a pair of pants from the belt line to the region between the middle of the thigh to the back of the knee, from each outside seam to inside seam, and from the inside seam to the crotch. The insert is composed of three layers: an outside layer of water repellent, closed cell foam neoprene; a middle layer of a synthetic, thermal insulating fabric, such as Outlast.RTM. Zermatt; and an inner layer of a soft, flexible material, such as polar fleece. The three layers are sewn together. If additional protection is desired at the sewn seams, the seams may be heat-sealed with an overlay of thermoplastic tape. Alternatively, the insert may be composed of two layers: an outside layer of water repellent, closed cell foam neoprene; and an inner layer of a composite fabric combining a synthetic, thermal insulating material with a soft, flexible material, viz., Outlast.RTM, Glacier or Outlast.RTM, Glenpile.

Prior art U.S. Pat. No. 5,649,328, issued Jul. 22, 1997 to Martin, describes a garment for wearing while In-Line Skating that comprises a pair of loose fitting outer shorts and form fitting inner shorts. Both shorts have padded portions to absorb the impact of a fall when landing on the hips, buttocks and or coccyx. The impact protection is provided by a fixed pad in the inner shorts and by removable pads that fit securely into pockets on the rear portion of the outer shorts. The outer shorts also providing abrasion and cut protection by utilizing highly abrasion resistant fibers in the rear section.

Prior art U.S. Pat. No. 6,182,288, issued Feb. 6, 2001 to Kibbee, indicates a garment anchoring system and method. A body armor vest is anchored at the waist of a wearer by providing an elastic lower garment, preferably in the form of a legged brief type undergarment that snugly fits the lower torso of the wearer. The lower garment anchors the vest in place by attaching along a strip across the front and back of the vest at the waist. The lower garment distributes an elastic force that horizontally and vertically returns the vest, when pulled out of position by the movement of the wearer, to its intended position, with the waist level thereof centered at the front and back of the wearer's waist. Detachable fasteners are provided to allow the easy putting on, adjustment and removal of the vest and lower garment combination. With the legged brief version of the lower garment, the fasteners preferably include strips of hook and loop material sets at the front and back of the waist on the vest shell and lower garment. The lower garment, particularly the legged version, is particularly adaptable to use in a kit for anchoring bulletproof vests as well as other garments.

Prior art U.S. Pat. No. 6,231,411, issued May 15, 2001 to Vinay, puts forth a fashionable life saving device that utilizes the look of casual clothing such as shorts, pants, bathing suits or skorts to disguise inflatable chambers. The invention comprises a gas canister, safety devices including a manual inflation tube, thereby providing a subtle way to ensure safety in and around the water. When inflated, the chambers rest under the user's arms, but are safely attached to his waist or the lower part of his body for security and safety.

Prior art U.S. Pat. No. 3,329,966, issued Jul. 11, 1967 to Slavik, concerns a form-fitting garment in the nature of a pair of trousers. The garment made from rubber, neoprene sponge or a similar material is suitable for use as an article of skin diving apparel, foul-weather gear or the like. In the manufacture of garments such as skin diving pants and the like, designed to be used for active sports or work, provide protection to the wearer against cold surrounding water or weather. It is desirable that the garment fit the contour of the wearer's body as closely as possible, for both freedom of action and for efficiency of insulation.

What is needed is a wet suit garment that can be worn under surfing shorts to allow a much longer time in the water while surfing in waters not requiring a full wet suit while still maintaining the preferred style of surfing shorts.

SUMMARY OF THE INVENTION

An object of the present invention is to provide a wet suit garment that can be worn under surfing shorts to allow a much longer time in the water in comfort while surfing in waters not requiring a full wet suit.

Another object of the present invention is to provide an outer garment that covers the wet suit garment, so externally the wearer can maintain their preferred style of surfing shorts.

One more object of the present invention is to provide an interconnecting means, preferably hook and loop, which is located at the waist of both garments so they are capable of remaining interconnected during water sports activity.

An additional object of the present invention is to attach the smooth loop portion of the mating pair of hook and loop fasteners to the inner waist portion of the pair of outerwear short pants allowing the short surfing pants to be worn comfortably without the wet suit underpants garment.

Yet another object of the present invention is to provide a pair of outerwear short pants capable of covering and concealing from view the wet suit underpants garment.

Yet one more object of the present invention is to help prevent skin rash by having the wet suit underpants garment under surfing shorts.

In brief, a wet suit undergarment and surfing shorts combination that allows a wearer to stay a much longer time in the water while surfing in waters not requiring a full wet suit while still maintaining their preferred style of surfing shorts. The combination comprises a wet suit underpants garment formed of insulating material capable of covering and conforming to the body of a wearer from their waist to their thighs. The wet suit underpants garment traps a thin layer of water between itself and the wearer's body, thereby maintaining the temperature of the thin layer of water similar to the temperature of the body of the wearer. The combination further comprises pair of outerwear short pants capable of covering and concealing from view the wet suit underpants garment. An interconnecting means, preferably of hook and loop fastener material, is located around at least a portion of the waist of both garments. The interconnecting means is capable of securing the wet suit underpants garment to the pair of outerwear short pants so they are capable of remaining interconnected during water sports activity. The smooth loop portion of the mating pair of hook and loop fasteners is attached to the inner waist portion of the pair of outerwear short pants allowing the short surfing pants to be worn comfortably without the wet suit underpants garment. The surfing shorts are secured on the wearer with a tie string means. Preferably, the interconnecting means on waistband of the wet suit underpants garment and the surfing shorts are attached around the waistband up to the tie string means.

An advantage of the present invention is in providing a way for the wearer to stay in the water longer without wearing a full wet suit.

Another advantage of the present invention is the wearer can maintain their preferred style of outer surfing shorts.

An additional advantage of the present invention is the surfer shorts conceal the wet suit underpants garment.

One more advantage of the present invention is the surfer shorts and the wet suit underpants garment can be interconnected.

Yet another advantage of the present invention is the surfer shorts can be worn without the wet suit underpants garment.

Yet one more advantage of the present invention is to help prevent skin rash while surfing.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIG. 1–4, a wet suit undergarment and surfing shorts combination 10 is shown. The combination 10 comprises a wet suit underpants garment 20 formed of insulating material, preferably Neoprene, capable of covering and conforming to the body of a wearer from the waist to the thighs and further capable of trapping a thin layer of water underneath the wet suit underpants garment 20, thereby maintaining the temperature of the thin layer of water similar to the temperature of the body of the wearer from the waist to the thighs of the wearer.

Figure 2:
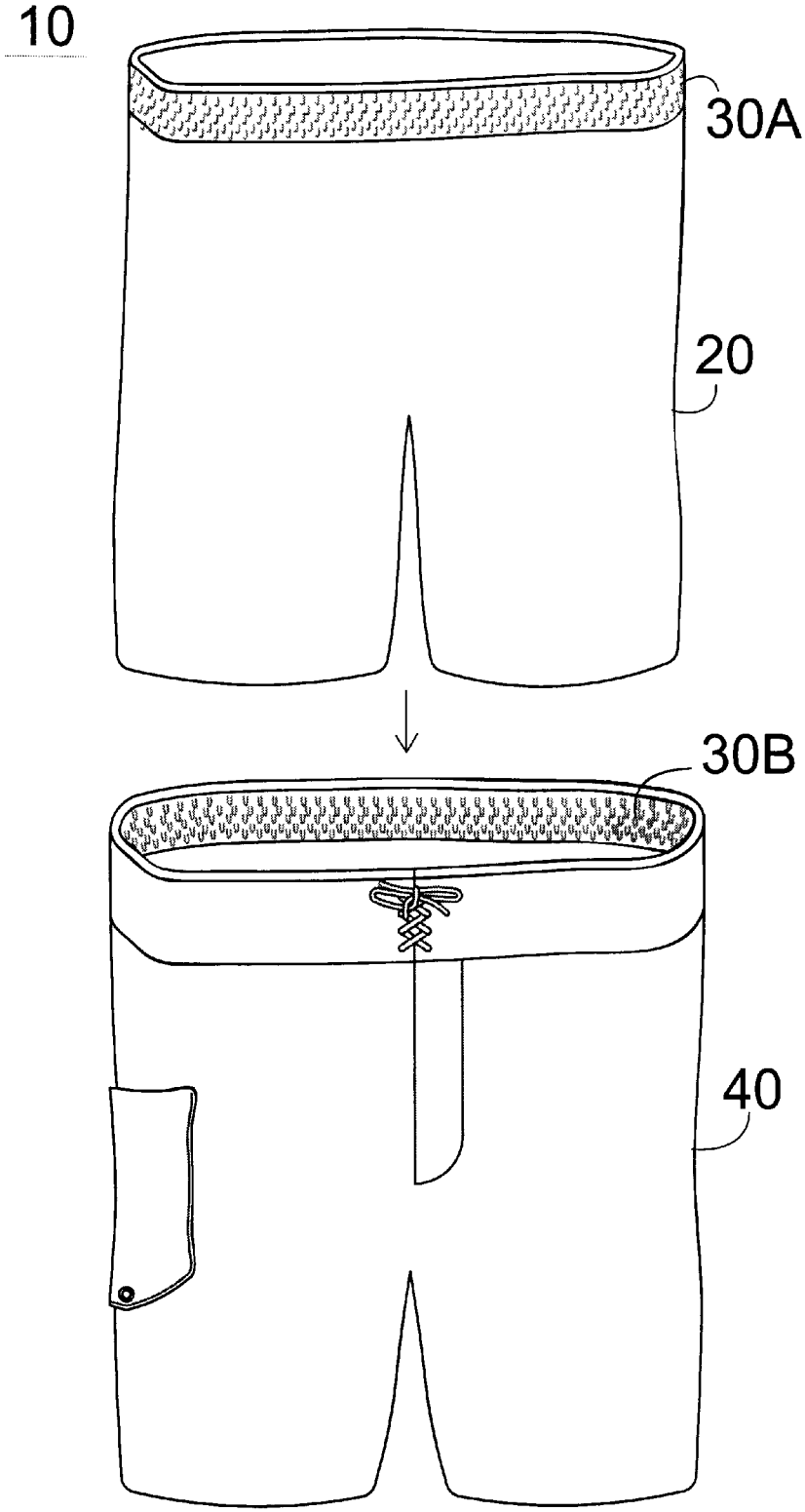
FIG. 2 is a perspective view of the wet suit underpants garment aligned for insertion within the surfing shorts.
Figure 3:
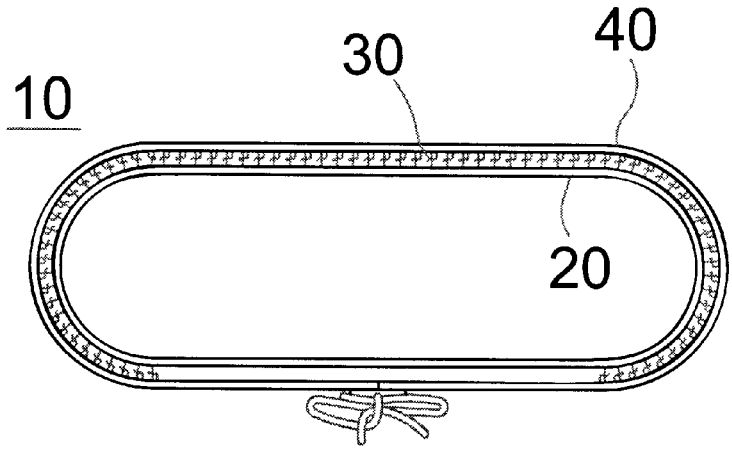
FIG. 3 is a top plan view of the wet suit underpants garment inserted within the surfing shorts showing the mating hook and loop fasteners between the two around the waistbands.
Figure 4:
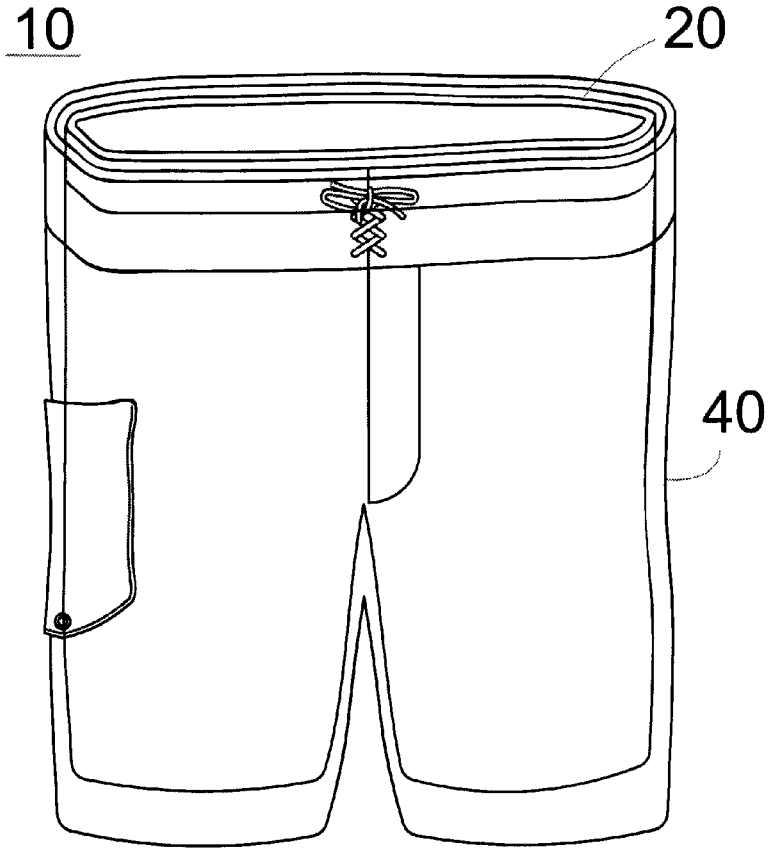
FIG. 4 is a perspective view showing the wet suit underpants garment inserted within the surfing shorts.

The combination 10 also comprises pair of outerwear short pants 40 capable of covering and concealing from view the wet suit underpants garment 20. The combination 10 further comprises an interconnecting means 30, preferably fashioned from a mating pair of hook and loop fasteners 30, around at least a portion of the waist of the wearer (as shown in FIG. 3). The interconnecting means 30 is capable of interconnecting the wet suit underpants garment 20 and the pair of outerwear short pants 40 so they are capable of staying connected during water sports activities. The hook portion 30A of the mating pair of hook and loop fasteners 30 is attached around an outside waist portion of the wet suit underpants 20 (as shown in FIG. 2). The smooth loop portion 30B of the mating pair of hook and loop fasteners 30 is attached to an inner waist portion of the pair of outerwear short pants 40 (as shown in FIG. 2) so the short pants 40 are capable of being worn without the wet suit underpants garment 20 with the smooth loop portion 30B of the mating pair of hook and loop fasteners 30 contacting the skin of the wearer. The pair of outerwear short pants 40 comprises a pair of surfing shorts that are secured on the wearer with a tie string means. The waist band of the wet suit underpants 20 and the surfing shorts 40 are each provided with a strip of mating hook and loop fasteners 30 that is attached around the waist band, preferably up to the tie string means.

Figure 1:
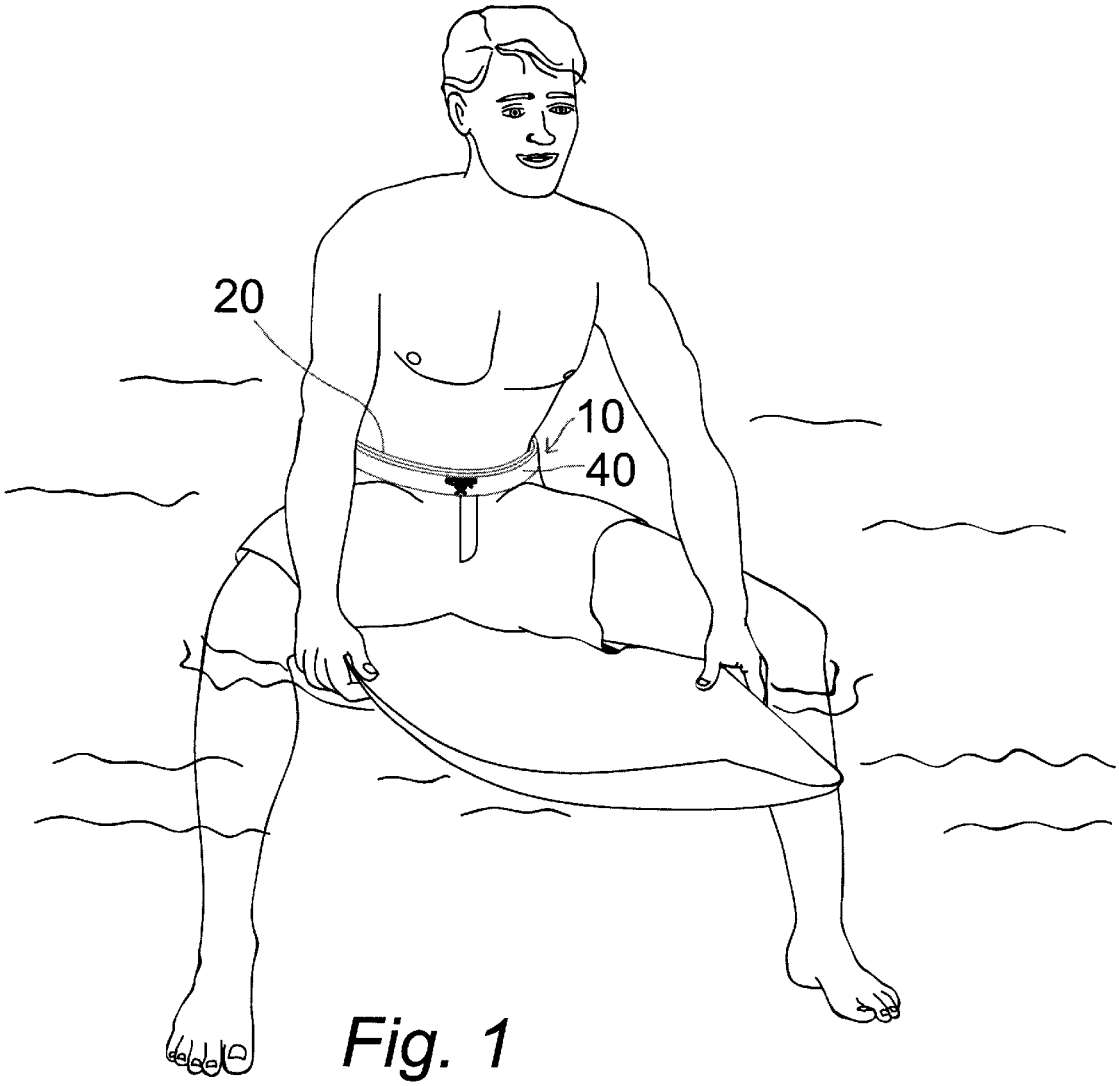
FIG. 1 is a perspective view of a surfer sitting on a surfboard wearing the combination wet suit underpants garment and surfing shorts which are in the water.

In practice, the wet suit underpants garment 20 and the surfing shorts 40 would be manufactured preferably with mating strips of hook and loop fastening devices 30 attached to their waistbands. The smooth loop portion 30B of the hook and loop material 30 is to be attached to the surfing shorts 40, allowing them to be worn comfortably without the wet suit underpants garment 20. The hook and loop fastening devices 30 would preferably extend around the waistbands up to the tie string of the surfing shorts 40 (as shown in FIG. 3). To wear the combination 10 of the wet suit underpants garment 20 and the surfing shorts 40 (as illustrated in FIG. 1) the wearer would first put on the wet suit underpants garment 20 and then the surfing shorts 40. The hook 30A and loop 30B portions of the interconnecting means 30 on the waistbands of the wet suit underpants garment 20 and the surfing shorts 40 would then need to be mated together (as shown in FIG. 3). The final step would be to securely tie the surfing shorts 40 around the wearer's waist (as illustrated in FIG. 1).

It is understood that the preceding description is given merely by way of illustration and not in limitation of the invention and that various modifications may be made thereto without departing from the spirit of the invention as claimed.

What is claimed is:

1. A wet suit undergarment and surfing shorts combination comprising:

a wet suit underpants garment formed of insulating material capable of covering and conforming to the body of a wearer from the waist to the thighs of the wearer and further capable of trapping a thin layer of water underneath the wet suit underpants garment and capable of maintaining the temperature of the thin layer of water similar to the temperature of the body of the wearer from the waist to the thighs of the wearer;

a pair of outerwear short pants capable of covering and concealing from view the wet suit underpants garment; and an interconnecting means around at least a portion of the waist of the wearer capable of interconnecting the wet suit underpants garment and the pair of outerwear short pants so that they are capable of remaining interconnected during water sports activity.

2. The combination of claim 1 wherein the interconnecting means comprises a mating pair of hook and loop fasteners.

3. The combination of claim 2 wherein a hook portion of the mating pair of hook and loop fasteners is attached around an outside waist portion of the wet suit underpants and a smooth loop portion of the mating pair of hook and loop fasteners is attached to an inner waist portion of the pair of outerwear short pants so that the short pants are capable of being worn without the wet suit underpants garment with the smooth loop portion of the mating pair of hook and loop fasteners contacting the skin of the wearer.

4. The combination of claim 1 wherein the pair of outerwear short pants comprises a pair of surfing shorts.

5. The combination of claim 4 wherein the pair of surfing shorts are secured on the wearer with a tie string means.

6. The combination of claim 5 wherein a waist band of the wet suit underpants garment and the surfing shorts are each provided with a strip of mating hook and loop fasteners around the waist band up to the tie string means.

7. The combination of claim 1 wherein the wet suit underpants garment is fabricated of neoprene.

* * * * *